US006254185B1

(12) United States Patent
Staehlin et al.

(10) Patent No.: US 6,254,185 B1
(45) Date of Patent: Jul. 3, 2001

(54) WHEELCHAIR ACCESSIBLE STADIUM SEATING

(75) Inventors: John H. Staehlin, Lutherville; Thomas DeFelice, deceased, late of Baltimore, both of MD (US), by Donna Smith-DeFelice, legal representative

(73) Assignee: Volunteers for Medical Engineering, Baltimore, MD (US)

( * ) Notice: Subject to any disclaimer, the term of this patent is extended or adjusted under 35 U.S.C. 154(b) by 0 days.

(21) Appl. No.: 09/535,992

(22) Filed: Mar. 27, 2000

Related U.S. Application Data

(62) Division of application No. 09/022,526, filed on Feb. 12, 1998, now Pat. No. 6,059,361

(60) Provisional application No. 60/038,238, filed on Feb. 17, 1997.

(51) Int. Cl.[7] ..... A47C 15/00

(52) U.S. Cl. ..... 297/257; 297/331; 297/344.1

(58) Field of Search ..... 297/232, 240, 297/257, 248, 249, 344.1, 344.24, 234, 331, 335

(56) References Cited

U.S. PATENT DOCUMENTS

| | | | |
|---|---|---|---|
| 175,352 | | 3/1876 | Hyland . |
| 276,830 | | 5/1883 | Knight . |
| 330,222 | | 11/1885 | Gaylord . |
| 636,405 | | 11/1899 | Hosmer . |
| 709,286 | | 9/1902 | Wilkinson . |
| 775,879 | * | 11/1904 | Wiersching et al. . |
| 941,983 | | 11/1909 | Gunn . |
| 941,988 | | 11/1909 | Elsner . |
| 1,007,041 | | 10/1911 | Miller . |
| 1,015,799 | | 1/1912 | Hazen . |
| 1,318,439 | | 10/1919 | Erickson . |
| 2,604,925 | | 7/1952 | Swift . |
| 3,191,400 | | 6/1965 | Swenson . |
| 3,229,940 | | 1/1966 | Kagels . |
| 3,275,283 | | 9/1966 | Rauch . |
| 3,708,203 | | 1/1973 | Barecki et al. . |
| 4,662,679 | | 5/1987 | Franck et al. . |
| 5,083,836 | | 1/1992 | Beasley . |
| 5,201,567 | | 4/1993 | Beasley . |
| 5,299,852 | | 4/1994 | Beasley . |
| 5,328,231 | * | 7/1994 | Raymond . |
| 5,456,518 | * | 10/1995 | Kemppainen et al. . |

OTHER PUBLICATIONS

Engineering drawing of "Swing Away Chair" of Irwin Seating Co., Grand Rapids, MI, 1 page.

Accessible Products Brochure of American Seating Co., Grand Rapids, MI, 1992, 4 pages.

* cited by examiner

*Primary Examiner*—Milton Nelson, Jr.

(74) *Attorney, Agent, or Firm*—Finnegan, Henderson, Farabow, Garrett & Dunner, L.L.P.

(57) ABSTRACT

A seating arrangement comprising two seats mounted to a single support pole, each seat capable of being rotated about the support pole and stowed independently of the other. The seating arrangement may also include a single seat slidably and rotatably mounted to a support pole.

4 Claims, 17 Drawing Sheets

WHEELCHAIR ACCESSIBLE STADIUM SEATING

This is a divisional of application Ser. No. 09/022,526, filed Feb. 12, 1998, now U.S. Pat. No. 6,059,361, which is incorporated herein by reference.

This application claims priority under 35 U.S.C. § 119(e) based on Provisional Application Serial No. 60/038,238, filed Feb. 19, 1997.

BACKGROUND OF THE INVENTION

Seating arrangements at stadiums and other large facilities around the world are primarily designed to accommodate able-bodied persons by using basic fold-down seating configurations. Individuals in wheelchairs are generally limited to sitting in areas allocated for wheelchair use at predetermined locations throughout the stadium. The advent of the Americans with Disabilities Act (ADA), which mandates the scope of the accommodations that must be provided for individuals in wheelchairs, has prompted stadium owners to expand the seating areas for these individuals.

The seating arrangements prevalent in today's newly erected stadiums accommodate wheelchairs by providing individual seats mounted on a single post that fold up and swing away to provide an area between the posts sufficiently large for a wheelchair. This distance, which must be at least thirty-three inches as required by the ADA, dictates the number of seats available in a given row. This configuration requires a minimum separation distance between each post in a given row of seats. Conventional wheelchair accessible stadium seating merely provides sixty-six inches of open space between two folded seats to accommodate two individuals in wheelchairs. Accordingly, these seating configurations must necessarily allow for empty space between the adjacent posts upon which the individual seats are mounted, creating an inefficient waste of space between adjacent posts. As such, the conventional stadium seating fails to maximize the seating space achieved by the current invention.

Moreover, these individual seats are mounted on single posts and are stowed by pivoting the seating area upward and rotating the entire seat about a fixed pivot point. However, because the seat if fixed at the pivot point, the rotated seat encroaches upon the aisle behind where the individuals in wheelchairs are seated.

Conventional handicapped seating has another inherent drawback in that when folded and pivoted away, the seat effectively creates a "wall" or barrier between either the individual in the wheelchair and an individual in a standard seat, or between two individuals, both in wheelchairs.

SUMMARY OF INVENTION

Accordingly, the present invention is directed to a seating system that substantially obviates one or more of the problems due to limitations and disadvantages of the related art. The seating arrangement of the present invention is configured so that two seats mounted on a single post are capable of folding and swinging away, effectively eliminating the wasted space associated with mounting each seat on its own corresponding post. The use of contiguous sets of tandem seats maximizes the number of seats for both individuals in wheelchairs and those using conventional stadium seating.

The additional space created by the tandem seating arrangement allows for installation of more seats in a particular row or an additional sliding seat between sets of tandem seats. Configuring this single seat to have translational and pivotal movement in relation to the post allows this lineal row configuration to accommodate up to fifty percent more seats than the conventional seating design. Additionally, such a configuration allows the single seat, once it is folded and pivoted away, to be further displaced away from the aisle behind where the individuals in wheelchairs are seated. Utilization of the sliding support member in conjunction with the central pivot point on the single support post allows for significant flexibility in seating design.

An additional advantage of one embodiment of the present invention is that it eliminates the obstruction created by conventional folding seats by providing a stadium seat which folds downward, the folded seat resting proximate the individuals' legs, rather than obstructing the individuals' lateral view.

DETAILED DESCRIPTION

Reference will now be made in detail to the present preferred embodiments of the invention, examples of which are illustrated in the accompanying drawings.

Figure 1:
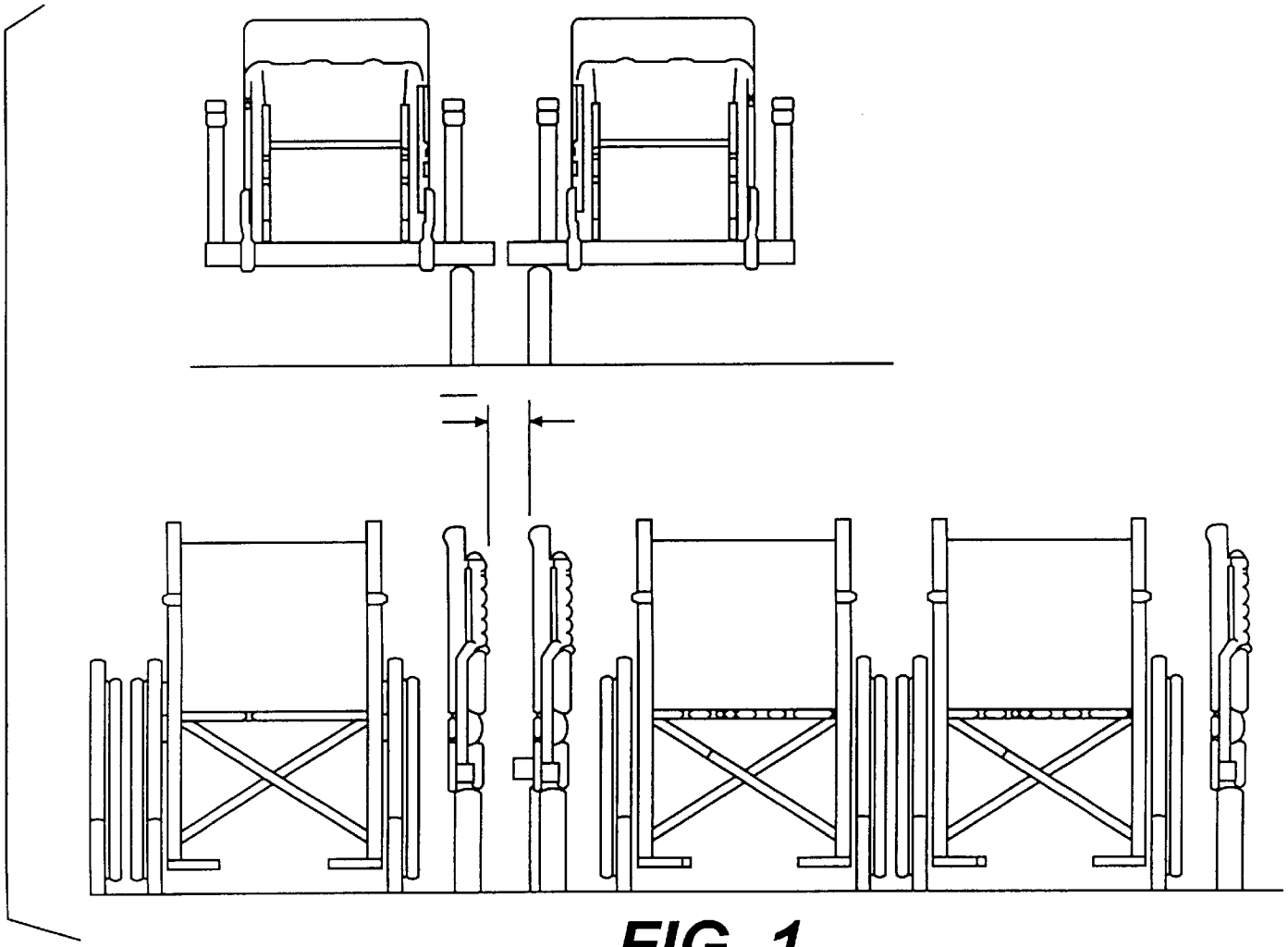
FIG. 1 PRIOR ART
FIG. 1 is a front view illustrating the space saved by the present invention.

As illustrated in FIG. 1, the conventional stadium seat configured to accommodate space for a wheelchair is singly mounted to a support pole. This configuration requires a separation distance (d) between the support poles of each seat. In a lineal role of seats, these separation distances (d)

take up considerable valuable space. The exemplary embodiment of the seating system of the present invention is shown in FIG. 2 and is designated generally by reference numeral (5).

Figure 2:
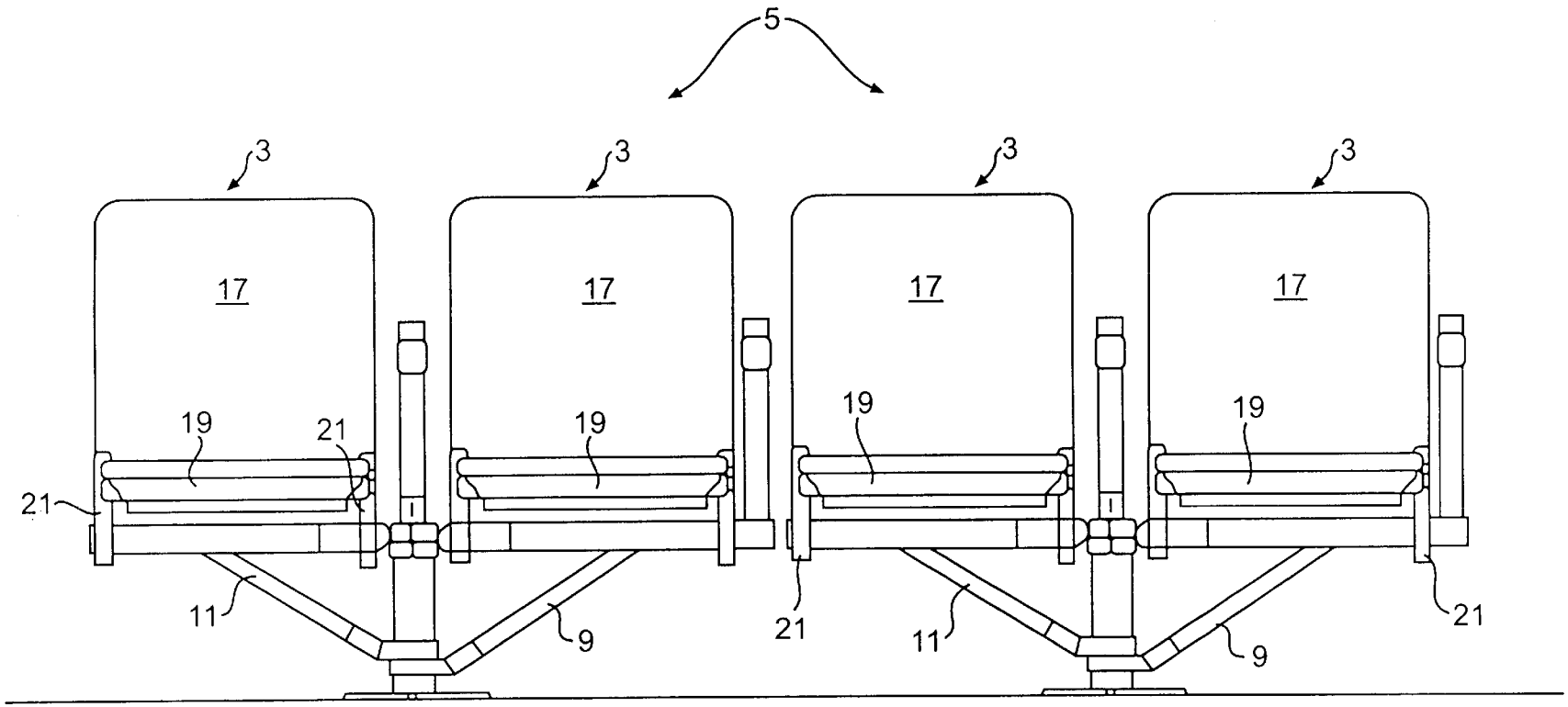
FIG. 2 is a front view of two tandem seat assemblies in series.
Figure 3:
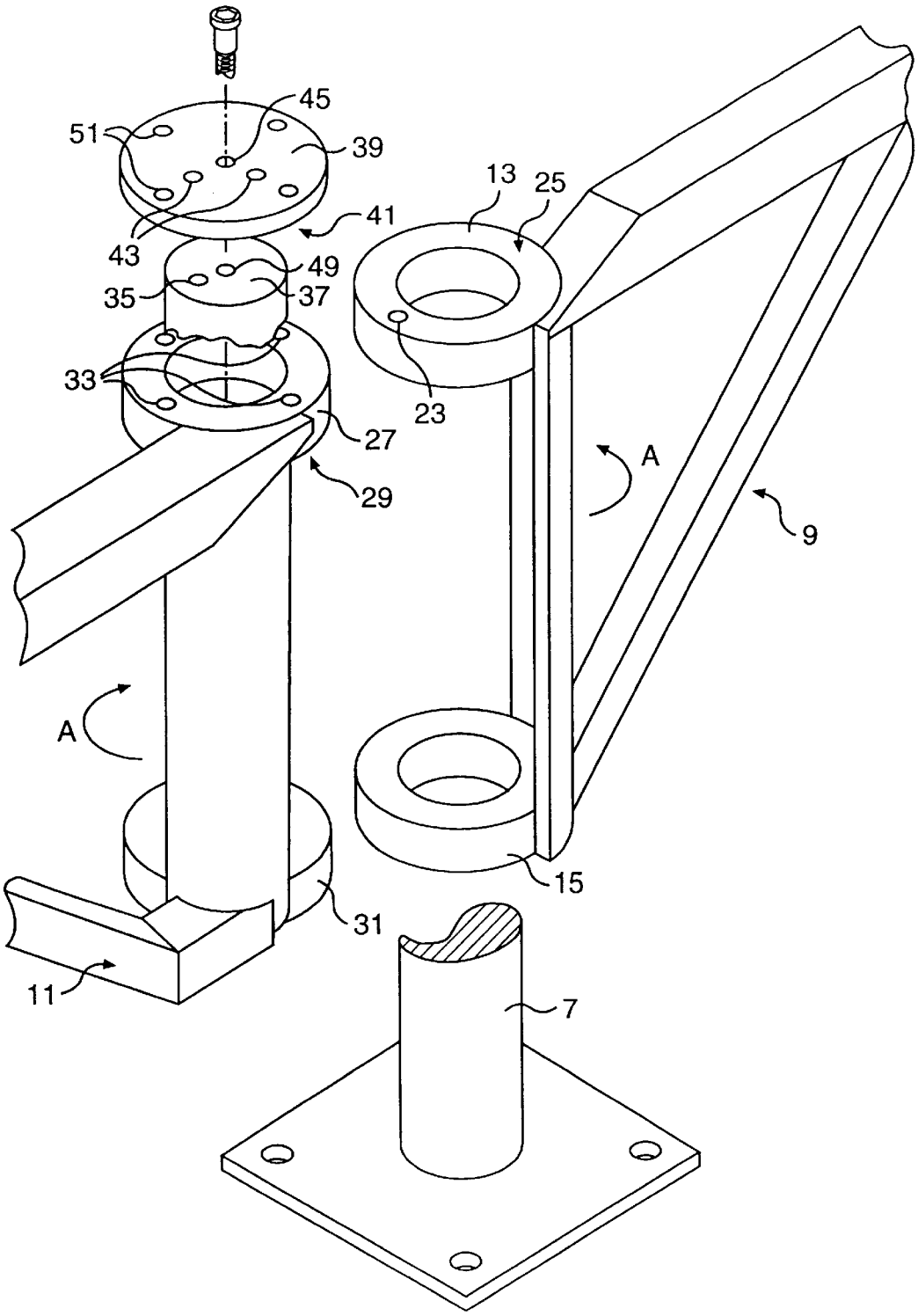
FIG. 3 is an exploded perspective view of two seat frames rotatably and slidably connected to a support pole.
Figure 4:
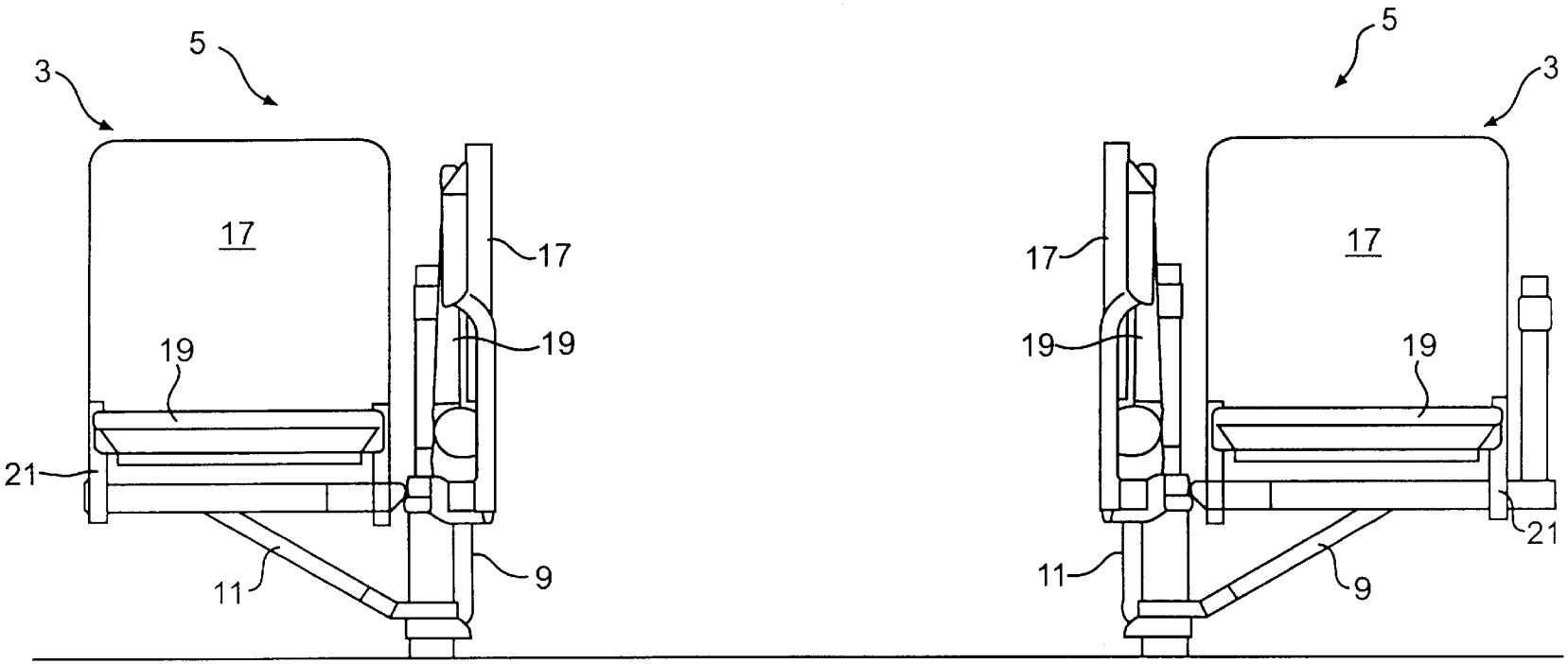
FIG. 4 is a front view of two tandem seat assemblies in series with two seats stowed for wheelchair accessibility.
Figure 5:
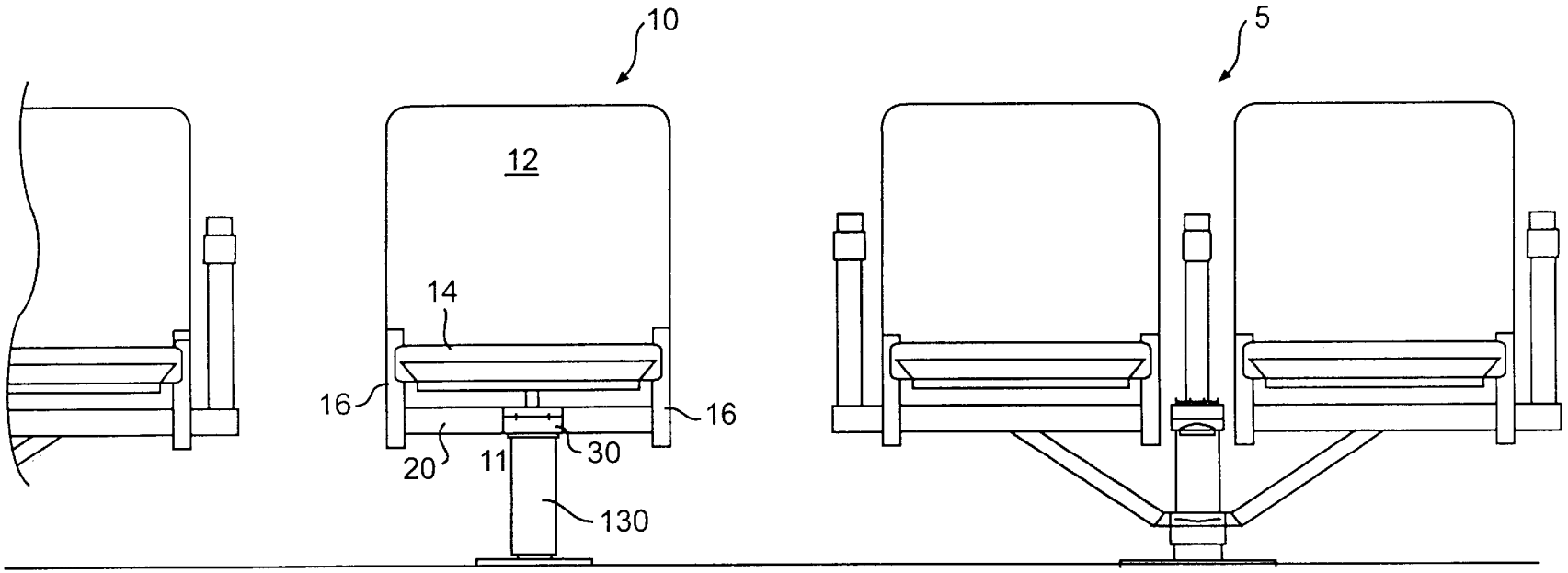
FIG. 5 is a front view of a single seat assembly with a sliding support member used in combination with a tandem seat assembly.

Referring now to FIGS. 2 through 5, a first embodiment of the tandem seat (5) will be described. The tandem seat (5) may be utilized in conjunction with other tandem seats (as shown in FIG. 2) or with a single seat (as shown in FIG. 5). The tandem seat (5) includes two seats (3) connected to a support pole (7). Each seat (3) has a seat back (17) and a folding seat portion (19). Each seat (3) is supported by right and left frames (9, 11), respectively. The seats (3) are connected to the frames (9, 11) by seat brackets (21).

Referring now to FIG. 3, the right frame (9) has an upper right flange (13) and a lower right flange (15). The upper right flange (13) has a flange dowel pin (23) on the top surface (25) thereof. The left frame (11) has an upper left flange (27) and a lower left flange (31). The underside (29) of the upper left flange (27) has three apertures (33), each sized to receive the flange dowel pin (23). The apertures (33) are positioned such that when the flange dowel pin (23) engages one of the apertures (33), the left frame (11) and the right frame (9) are oriented at either a 180° (as illustrated in FIG. 2), a 90° (as illustrated in FIG. 4), or a 0° angle (both seats stowed (not shown)) with respect to one another, depending on which aperture (33) the flange dowel pin (23) engages. Each flange (13, 15, 27, 31) is sized to be concentric about the support pole (7). The support pole (7) has a pole dowel pin (35) and a threaded hole (49) on its top surface (37). As best shown in FIG. 3, the underside (29) of the upper left flange (27) contacts the top surface (25) of the upper right flange (13). The lower left flange (31) rests atop the lower right flange (15). A cover plate (39) is bolted to the top surface of the left frame (11) and releasably engages the top surface of the support pole (7) to hold the left and right frames (9, 11) (and the seats (3) affixed thereto) in position. The lower surface (41) of the cover plate (39) has dowel bores (43) sized to engage the pole dowel pin (35). Extending through the cover plate (39) is a shoulder bolt hole (45) as well as bolt holes (51).

Referring now to FIG. 2, when in use, the left and right frames (9, 11) of the tandem seats (5) are oriented 180° with respect to one another. Either seat (3) may be stowed independently or both seats (3) may be stowed simultaneously. The seats (3) are placed in their compact configuration as follows. The left frame (11) is raised upwardly a distance defined by the length of the shoulder bolt (47). This distance is long enough for the flange dowel pin (23) to disengage one of the three holes (33) on the underside (29) of the top left flange (27) and for the pole dowel pin (35) to disengage on of the dowel bores (43) on the lower surface (41) of the cover plate (39). Once the left frame (11) is raised a distance sufficient to disengage the dowel pins (23, 35), the left frame (11) and the right frame (9) may pivot freely, independent of one another, as indicated by Arrow A in FIG. 3. The left and right frames (11, 9) may be rotated from a position where the left and right frames (11, 9) assume a 180° orientation with respect to one another (when the seats are in use) to a 90° orientation with respect to one another, or both frames may be stowed, assuming a 0° orientation with respect to one another (to accommodate a wheelchair). To assume one of these desired orientations, the flange dowel pin (23) engages one of the three holes (33) on the underside (29) of the top left flange (27) and the pole dowel pin (35) engages one of the dowel bores (43) on the lower surface (41) of the cover plate (39). The three holes (33) and the dowel bores (43) are positioned to accommodate various angular orientations and to lock frames (9, 11) in predetermined locations.

Figure 6:
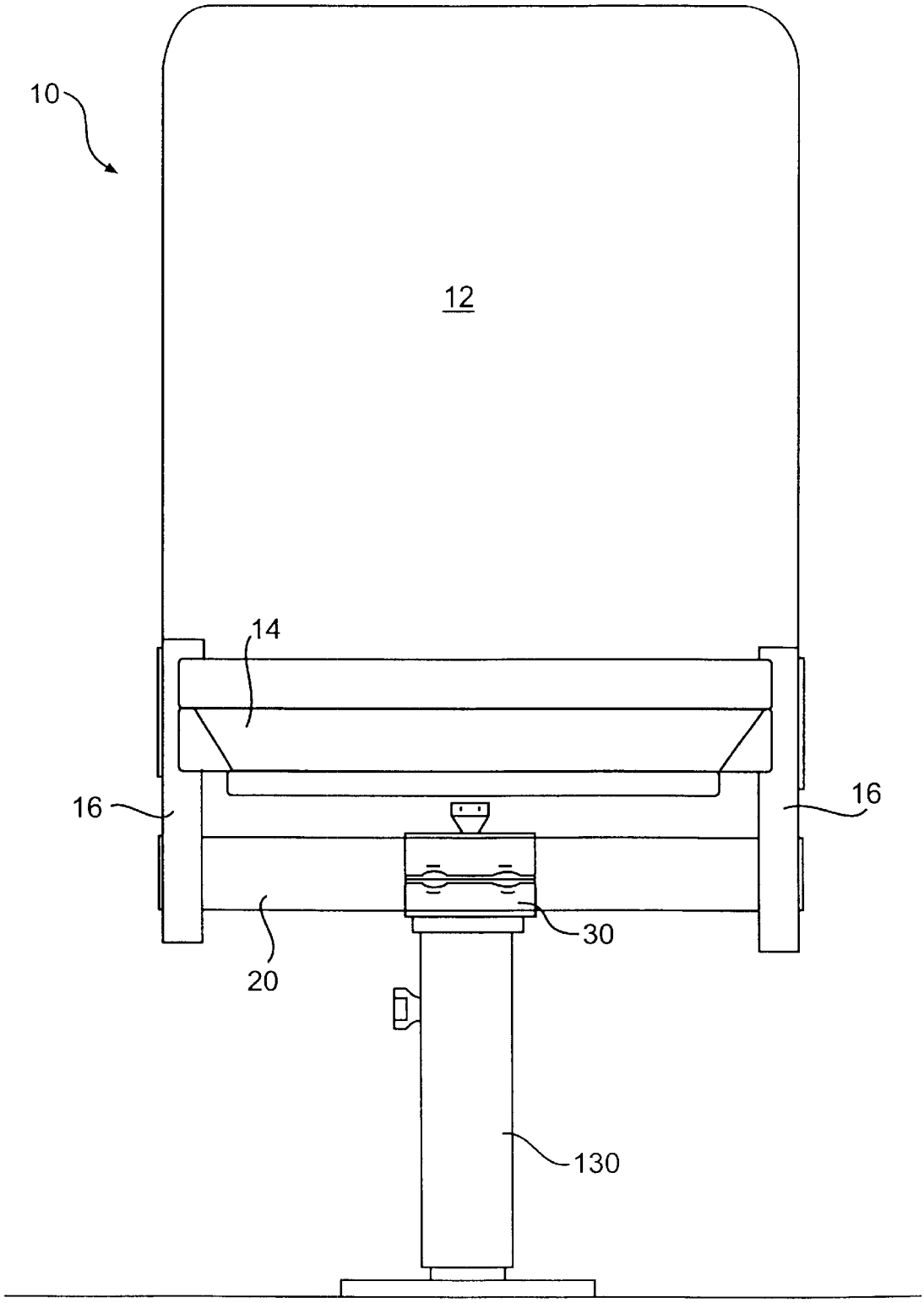
FIG. 6 is a front view of a single seat assembly with the seat centered on a sliding support member.
Figure 7:
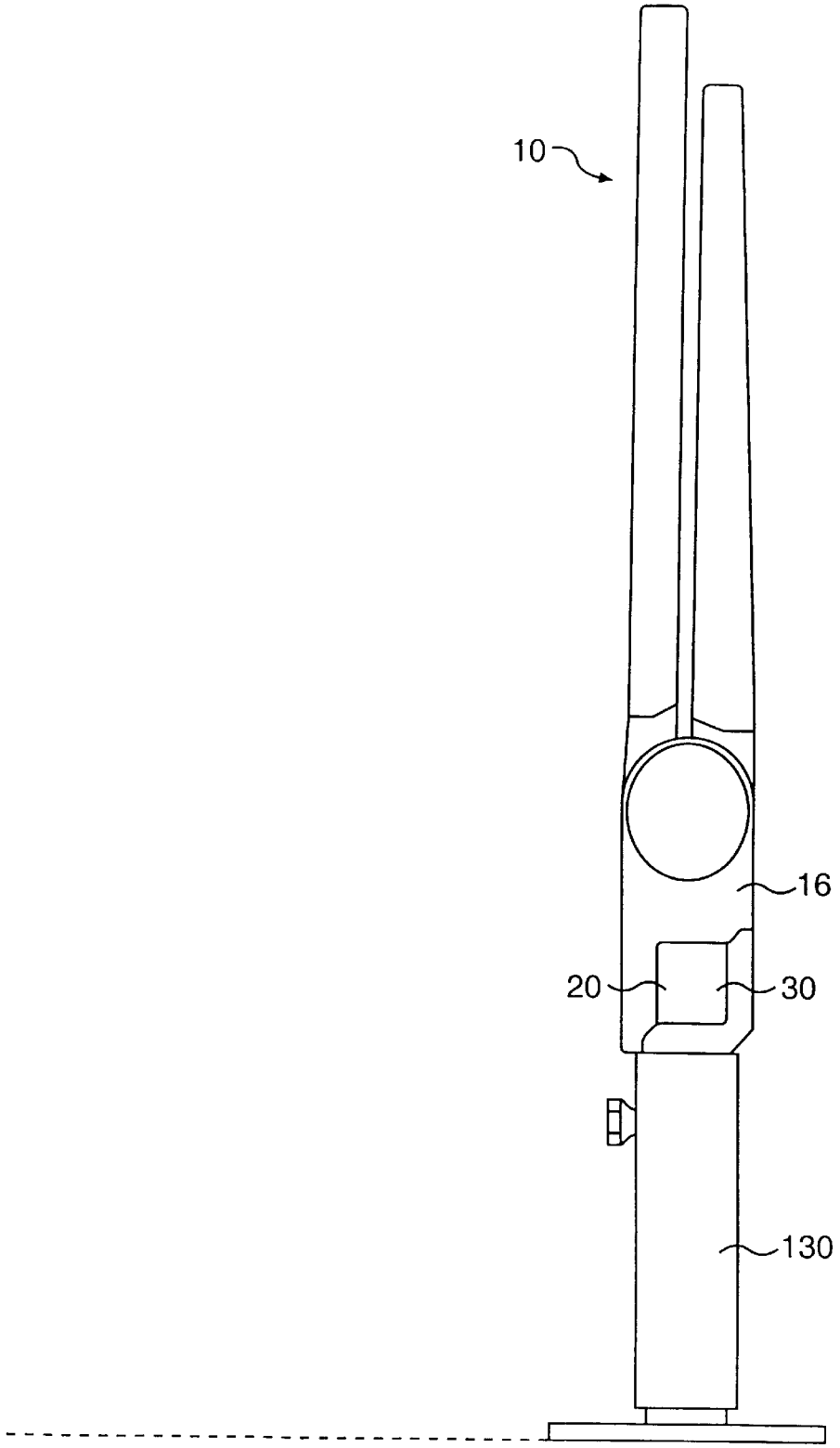
FIG. 7 is a side view of a single seat assembly with a sliding support member in its stowed position.

As embodied herein and referring to FIG. 5, the seat assembly may include a tandem seat (5) and a single seat (10). The tandem seat (5) and the single seat (10) may be used in combination with one another or each in combination with standard stadium seating. Referring now to FIGS. 5 and 6, the single seat (10) includes a back portion (12) and a seat portion (14). Like conventional stadium seating, the seat portion (14) is hingedly connected to the back portion (12). When folding the seat (10), the back portion (12) retains its perpendicular orientation with respect to the ground, whereas the seat portion (14) folds upwardly, lying in a substantially parallel plane with the back portion (12) (as illustrated in FIG. 7). A pair of connecting bars (16) connect the seat (14) and back (12) portions with a sliding support member (20). The single seat (10) is slidably mounted to a single support post (130) by attaching the sliding support member (20) to a central pivot (30). The sliding support member (20) may be mounted to the central pivot (30) by any conventional means, provided that the sliding support member (20) can freely move left and right with respect to the single support post (130) and can swivel about the central pivot point (30). The central pivot (30) may be located at the top of the support post (130) or, alternatively, may be attached at the bottom of the support post (130) and have a bar (not shown) running through the support post (130) to the sliding support member (20).

Figure 8:
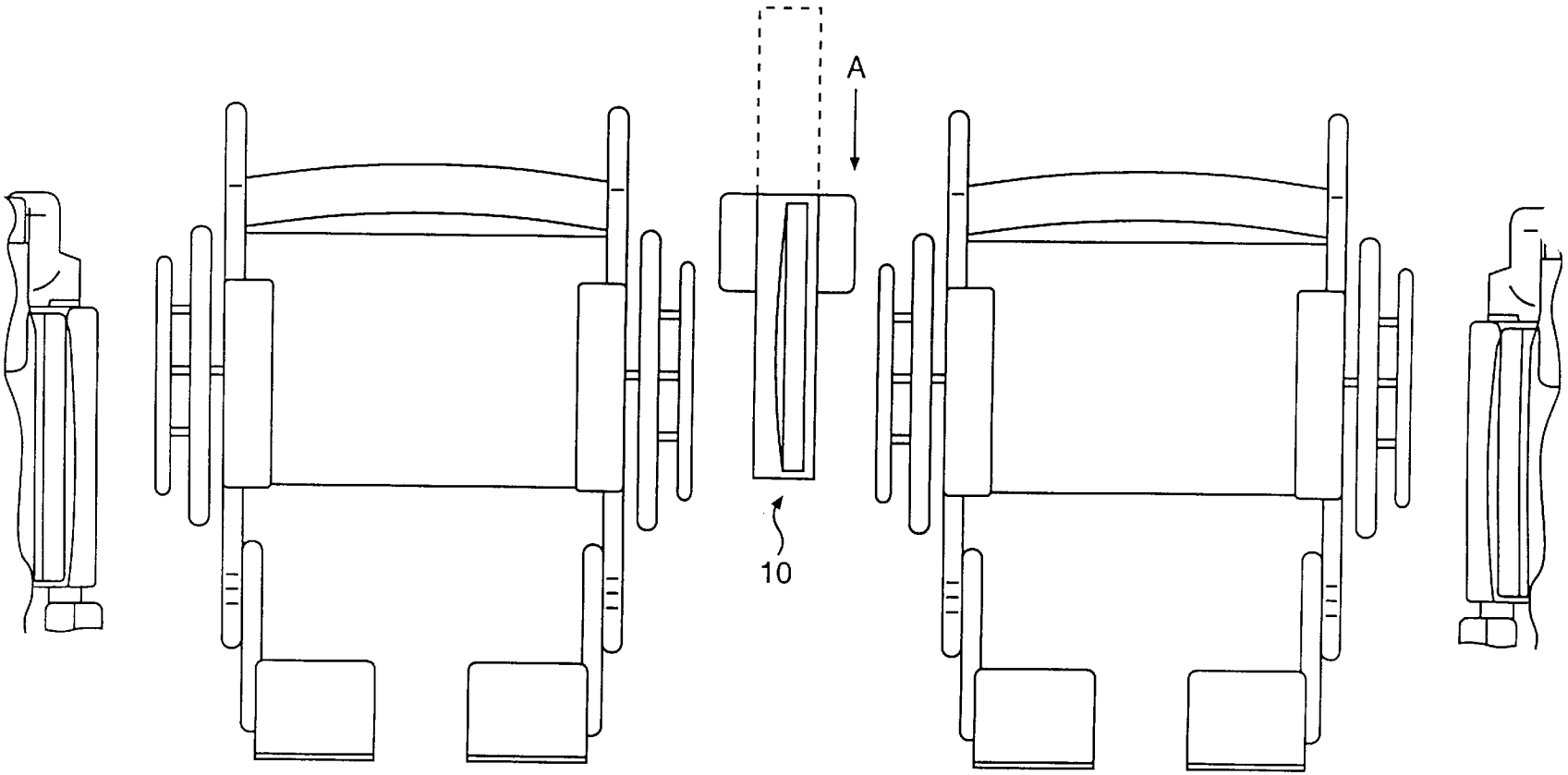
FIG. 8 is a top view of a single seat assembly in the stowed position used in combination with a dual seat assembly.
Figure 9:
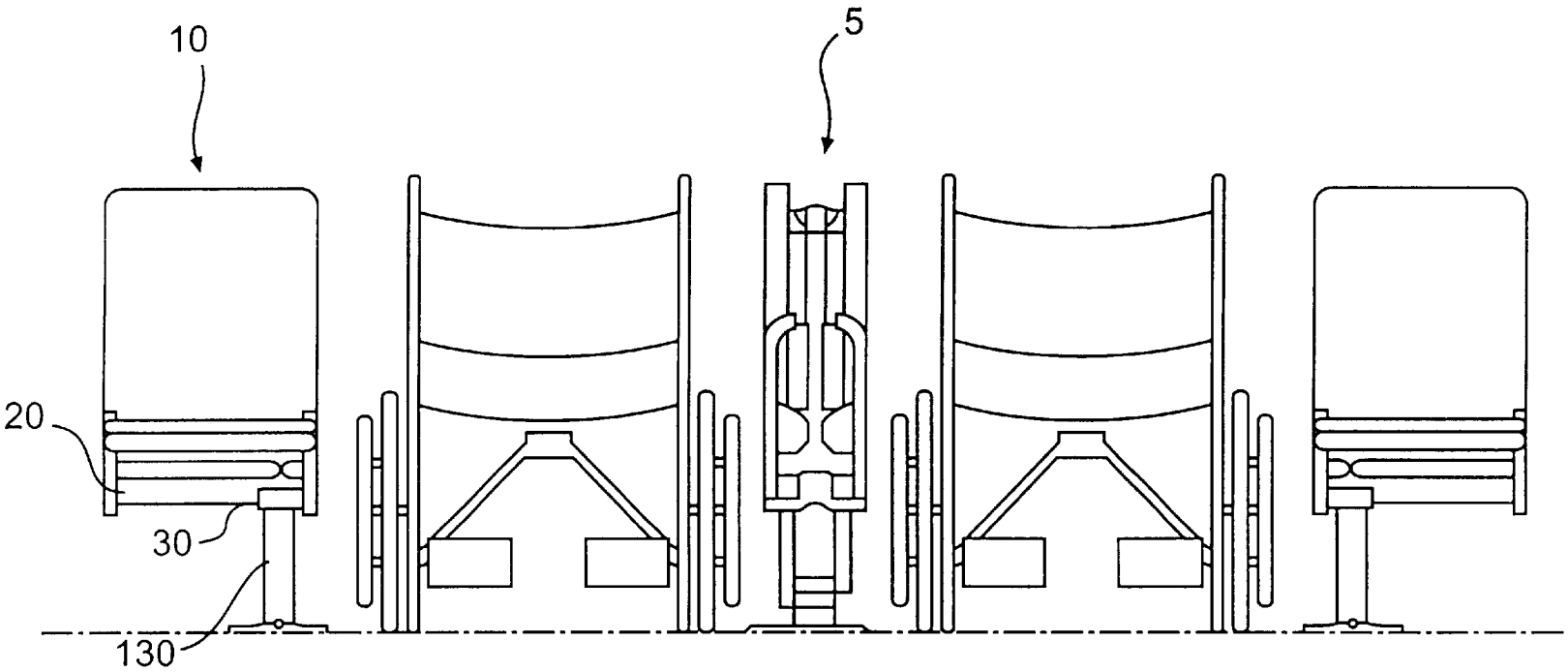
FIG. 9 is a front view of a single seat assembly with a sliding support member used in conjunction with adjacent wheelchair.
Figure 10:
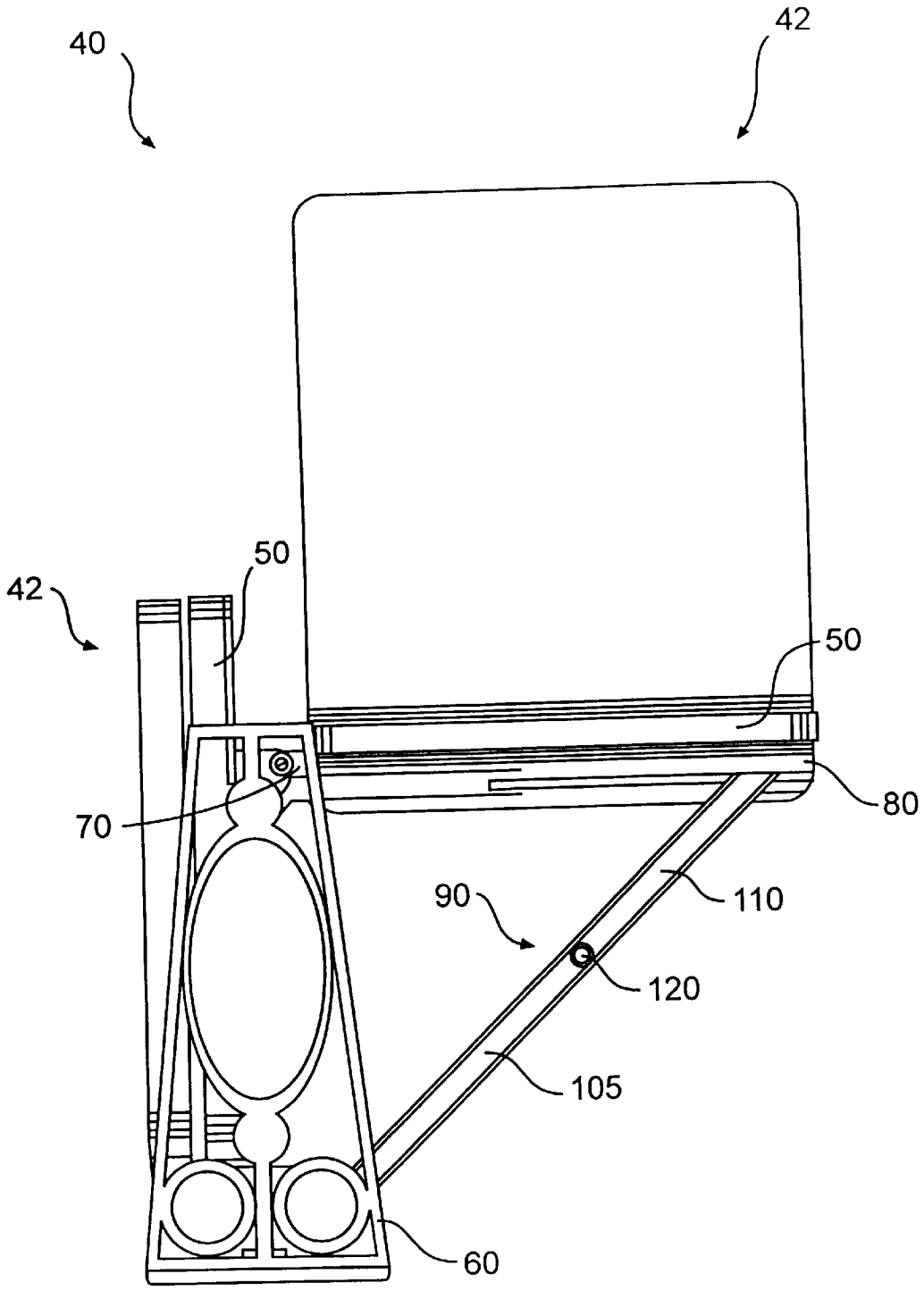
FIG. 10 is a front view of a dual seat assembly with one seat in its stowed position.
Figure 11:
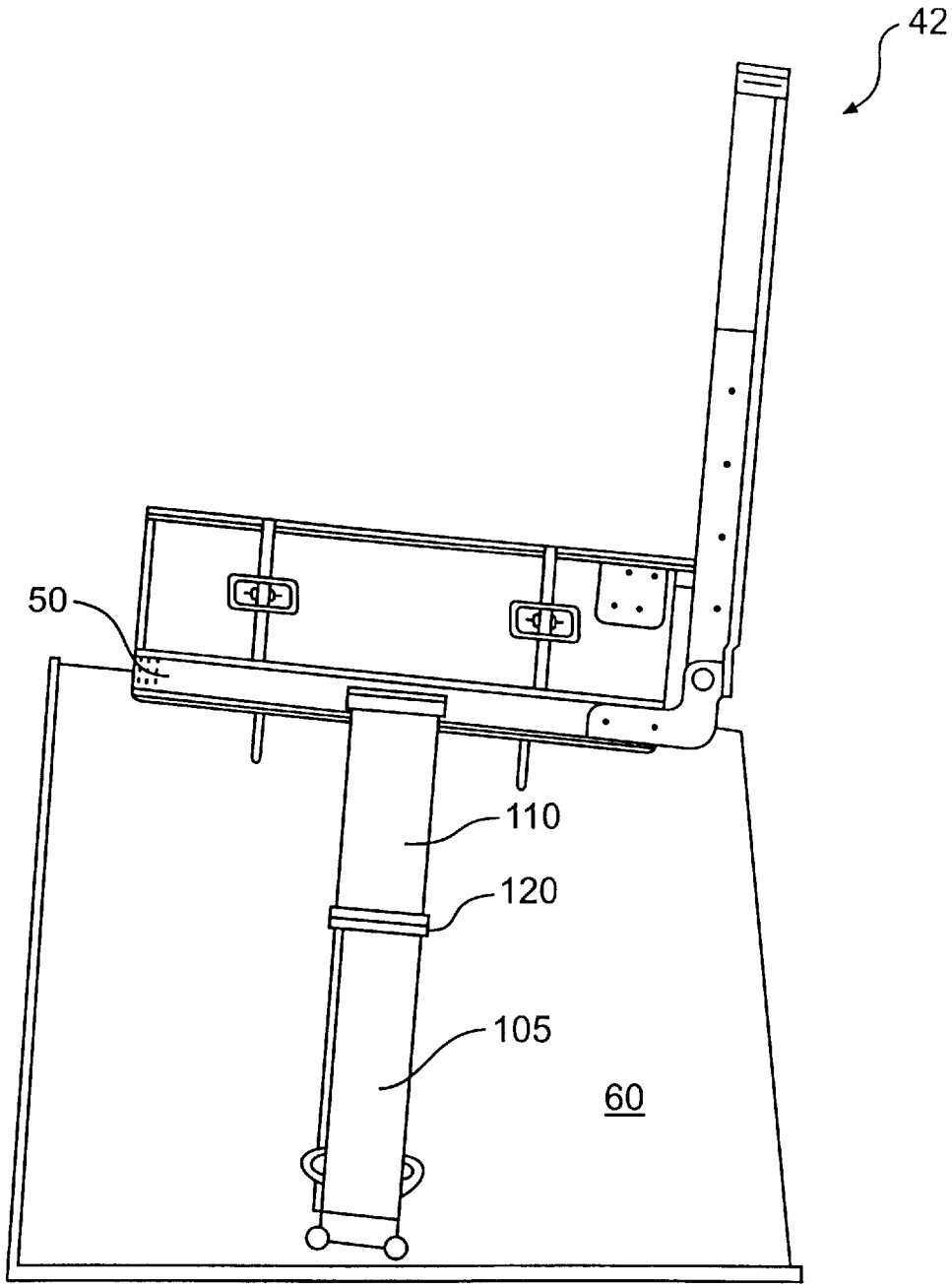
FIG. 11 is a side view of a dual seat assembly.
Figure 12:
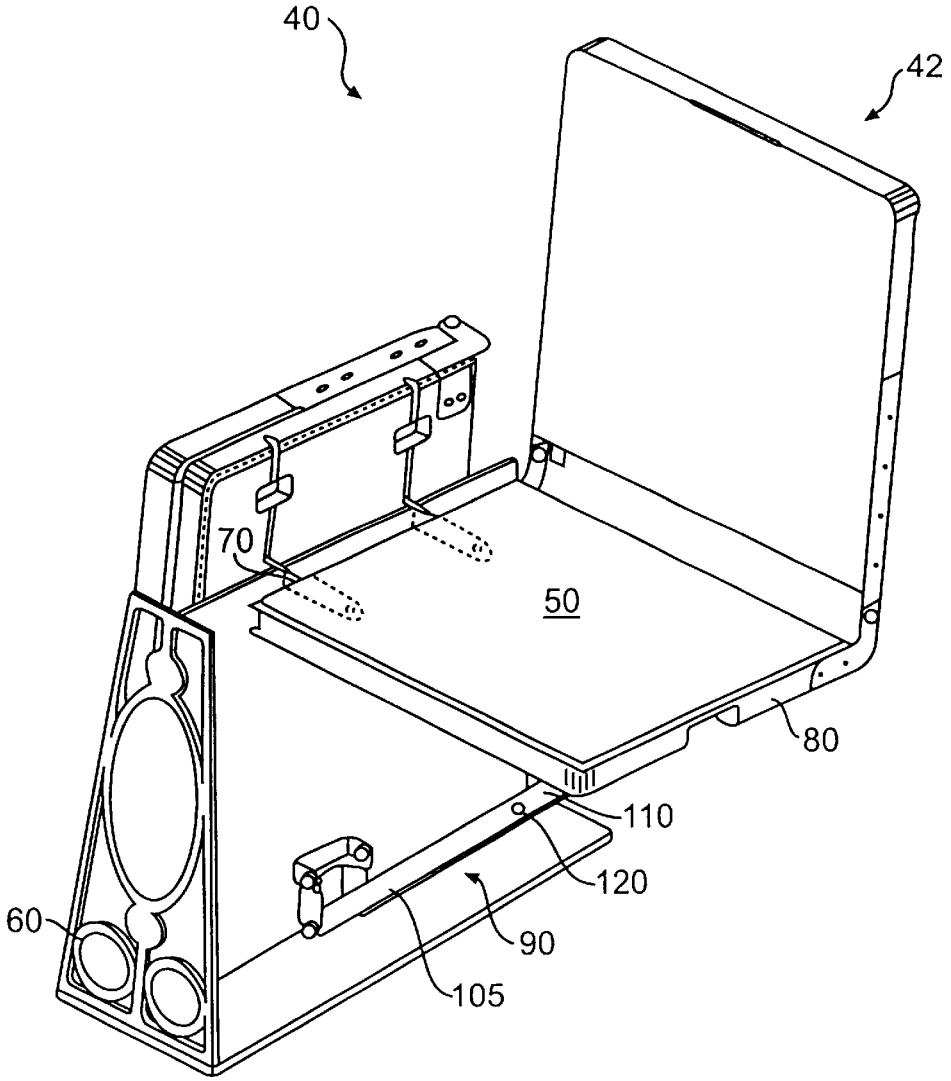
FIG. 12 is a perspective view of a dual seat assembly with one seat in its stowed position.

By mounting the seat in this fashion, the single seat (10), once it is folded and pivoted away, may be further displaced away from the aisle behind the space where the individuals in wheelchairs are residing, as illustrated by Arrow A in FIG. 8. Additionally, utilization of the sliding support member (20) in conjunction with the central pivot point (30) on the single support post (130) creates significant flexibility in seating design, maximizing the number of seats for both individuals in wheelchairs and those using the conventional stadium seating. As illustrated in FIG. 9, the single seat configuration (10) may be slidably positioned to either the left or the right of the central pivot point (30). This configuration allows for a wheelchair to be placed either to the left or to the right of the occupant residing in the single seat (10). For example, referring to FIG. 9, space for a wheelchair may be provided by sliding the single seat configuration (10) to the left and stowing away one of the seats of the tandem seat configuration (5). The single seat configuration (10) is positioned with respect to the tandem seating assembly (5) in such a manner as to allow for the requisite thirty-three inches of space when the single seat configuration (10) is slidably moved either to the left or to the right and one or both of the tandem seats (5) are stowed away.

Figure 13:
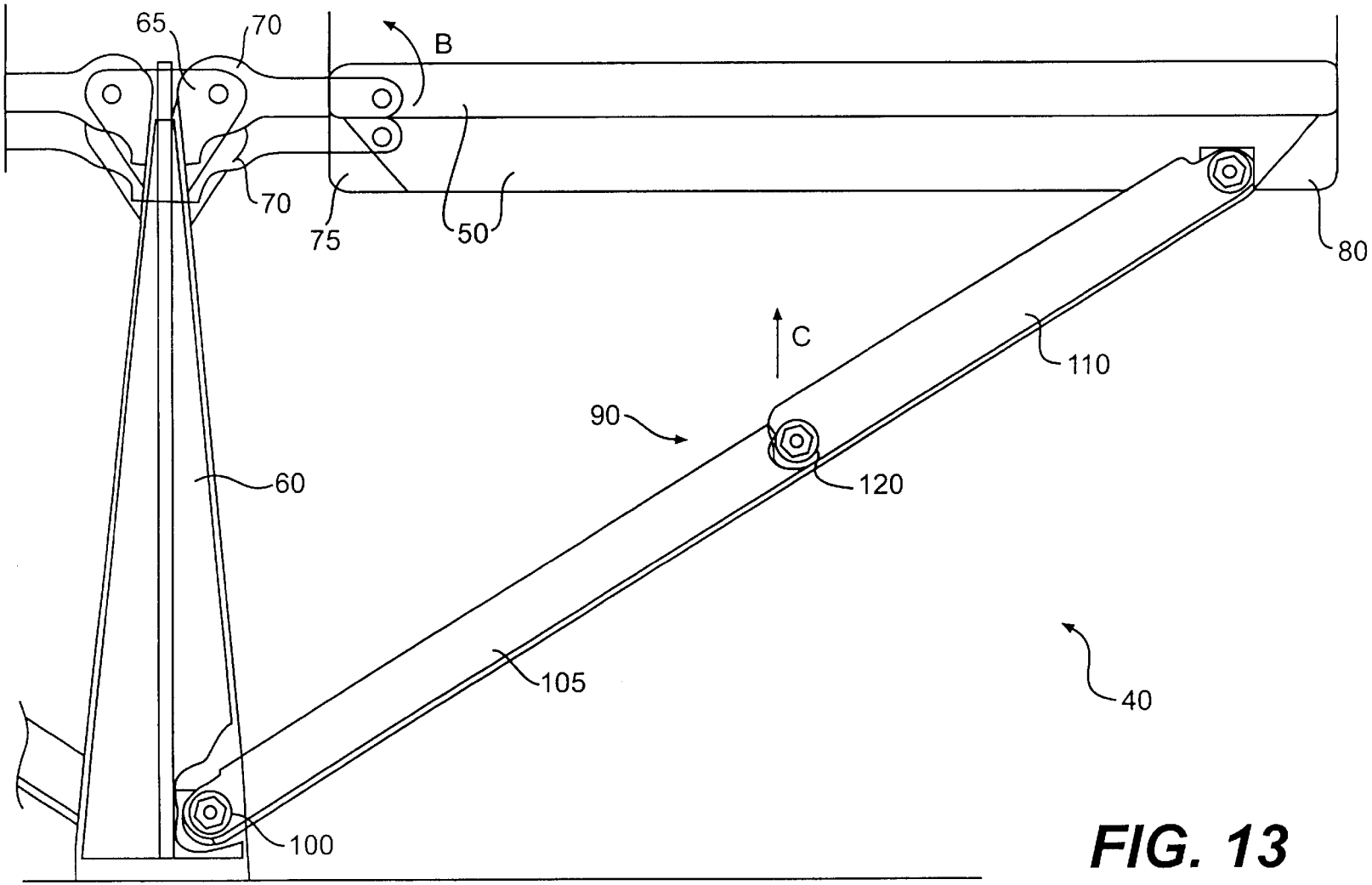
FIG. 13 is a front view of the hinged connections for a dual seat assembly.
Figure 14:
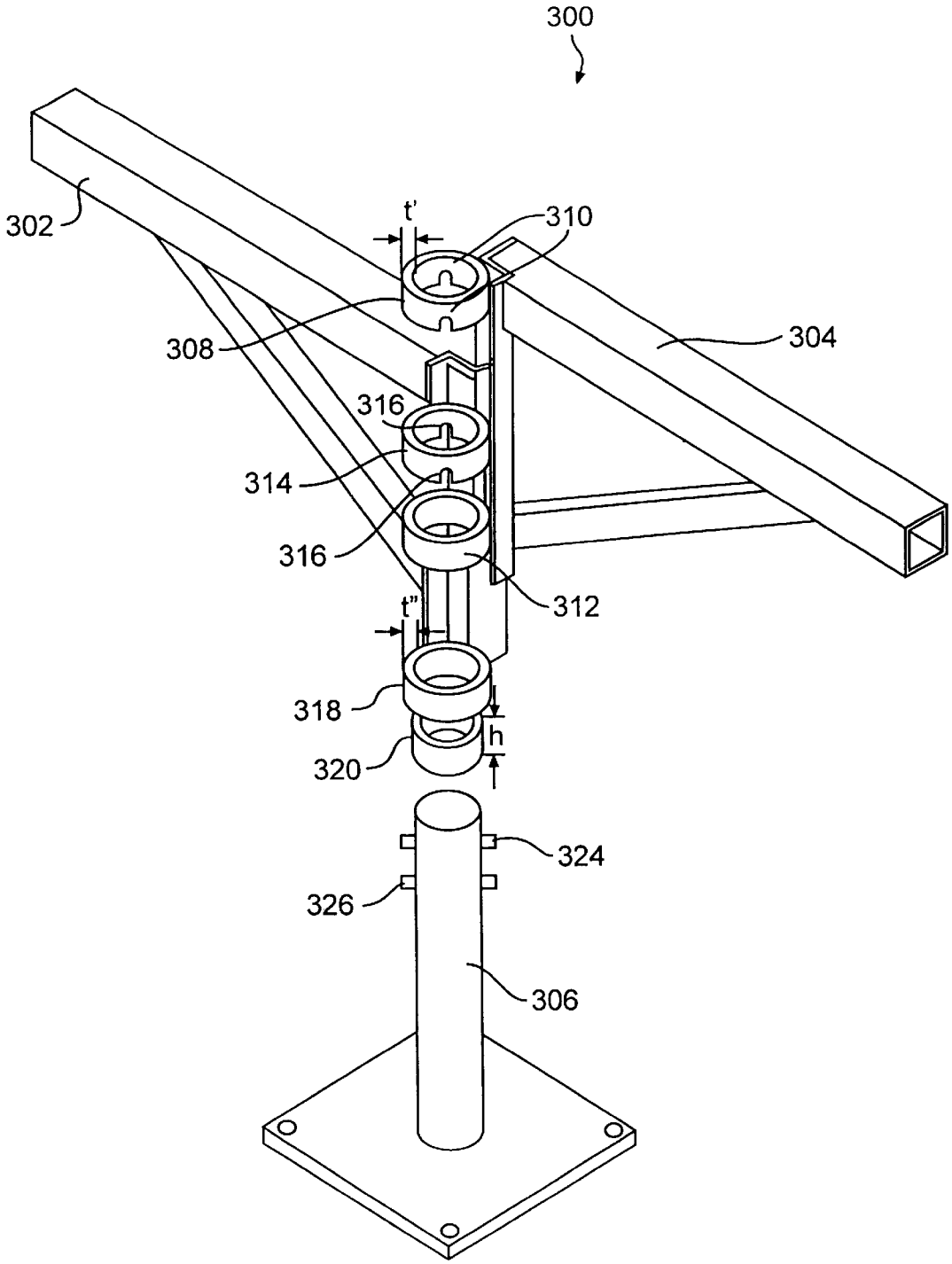
FIG. 14 is a perspective exploded view of two seat frames rotatably and slidably connected to a support pole.

Referring now to FIGS. 10 through 13, another embodiment of the invention will now be described. The tandem seating (40) incorporates a pair of folding seats (42) which fold downward. As best illustrated in FIG. 13, the seat portion (50) is attached to a central frame (60) by an L-shaped member (70) and by brace (90). The L-shaped member (70) is pivotally attached to the central frame (60) at bracket (65) and to the seat portion (50).

To place one of the folding seats (42) of the tandem seating (40) in a compact configuration, the pivot point connecting the L-shaped member (70) and the seat portion (50) is moved upward (illustrated by Arrow B in FIG. 13). Consequently, the left edge (75) of the seat portion (50) moves upward, while the right edge (80) moves toward the ground. The distance between the pivot point on the central frame (60) and the pivot point on the seat portion (50), defining the horizontal length of the L-shaped member (70), is such that when the pivot point on the seat portion (50) is raised upward, the seat portion (50) is allowed to pivot downward without its opposite edge (80) contacting the ground. To accommodate this type of downward folding configuration, a brace (90) is used. One end of the brace (90) is affixed to one end of a compensation link (200) at pivot point (210). The other end of the compensation link (200) is hingedly connected to the lower aspects of the central post (60) at pivot (100). The other end of the brace (90) is affixed to the underside of the seat portion (50), opposite the edge where the pivot point between the seat portion (50) and the L-shaped member (70) resides. The brace (90) is comprised of first and second elongated components (105, 110), pivotally connected to one another at a brace pivot point (120). The first and second elongated components (105, 110) are of suitable lengths to allow the seat portion (50) to nest against the central frame (60) in an approximately vertical position.

When the seat portion (50) is occupied, the brace (90) extends diagonally between the central frame (60) and the seat portion (50), with both first and second elongated components (105, 110) lying in a generally parallel plane. When folding the seat, the pivot point connecting the first and second elongated components (105, 110) of the brace (90) is moved upward (as illustrated by Arrow C in FIG. 13), causing the first and second elongated components (105, 110) to rotate, converging towards one another. As this rotation occurs, the first elongated component (105) rotates about pivot (210). The compensation link (200) in turn rotates upward about pivot (100). The compensation link (200) is sized to compensate for geometric length variations in the brace (90) associated with folding the seat downward to its stowed position. The first elongated component (105) is constructed such that it rests within the second elongated component (110) when the seat is completely folded, allowing for a compact configuration (see FIG. 10). The second elongated component (110) is substantially u-shaped and sized to receive the first elongated component (105).

Figure 15:
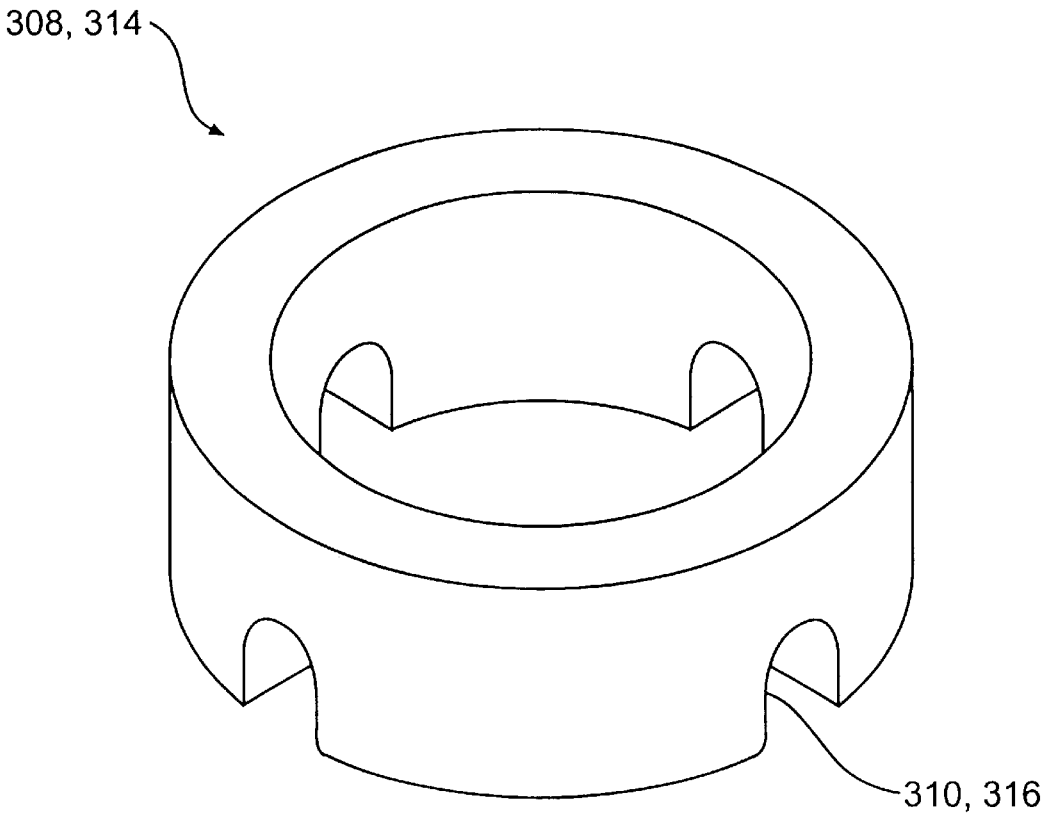
FIG. 15 is a perspective view of an index ring.

Referring now to FIGS. 14 through 17, another embodiment of the tandem seat will be described. As broadly shown in FIG. 14, the tandem seat (300) may have a left frame (302) and a right frame (304) rotatably and slidably attached to a support pole (306). The support pole (306) may be circular and includes an upper index pin (324) and a lower index pin (326). The right frame (304) may have an upper right index ring (308) and a lower right index ring (312), both sized to be concentric about the support pole (306), and both having a width '. As best shown in FIG. 15, the lower surface of the upper right index ring (308) has four upper index pin receiving portions (310) sized to receive the upper index pin (324) on the support pole (306).

The left frame (302) includes an upper left index ring (314) and a lower left index ring (318). The upper left index ring (314) is sized to be concentric about the support pole (306) and may have four lower index pin receiving portions (316) sized to receive the lower index pin (326) on the support pole (306) (shown in FIG. 15). The upper left index ring (314) has a width t'. The lower left index ring (318) has a width t" and is sized to be concentric about a spacer ring (320). The upper and lower left index rings (314, 318) have the same outside diameter as the upper and lower right index rings (308, 312). The upper and lower right index rings (308, 312) and the upper left index ring (314) have the same inside diameter. The inside diameter of the lower left index ring (318) is slightly larger than the inside diameters of the other rings (308, 312, 314), allowing the lower left index ring (318) to be concentric about the spacer ring (320). The spacer ring (320) has an inside diameter slightly larger than the outside diameter of the support pole (306) and an outside diameter slightly smaller than the inside diameter of the lower left index ring (318), but larger than the inside diameter of the lower right index ring (312).

Figure 16:
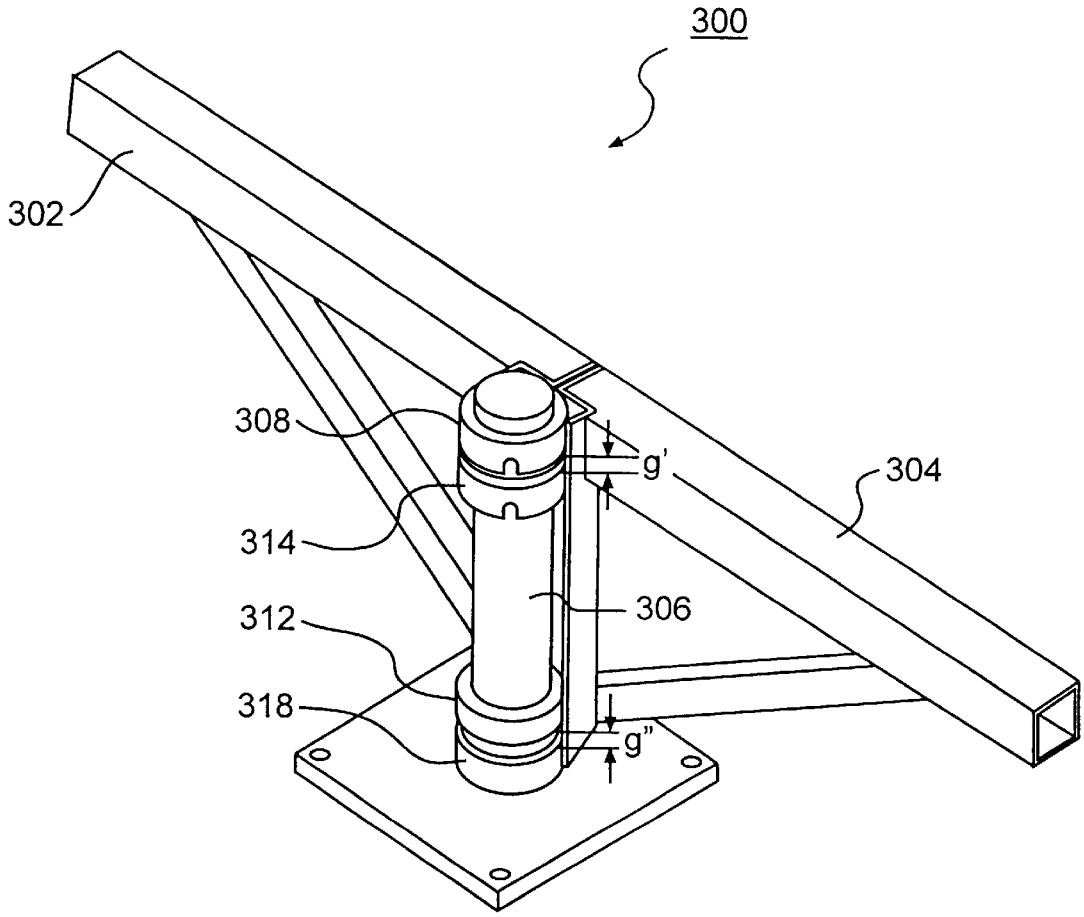
FIG. 16 is a perspective view of two seat frames rotatably and slidably connected to a support pole.
Figure 17:
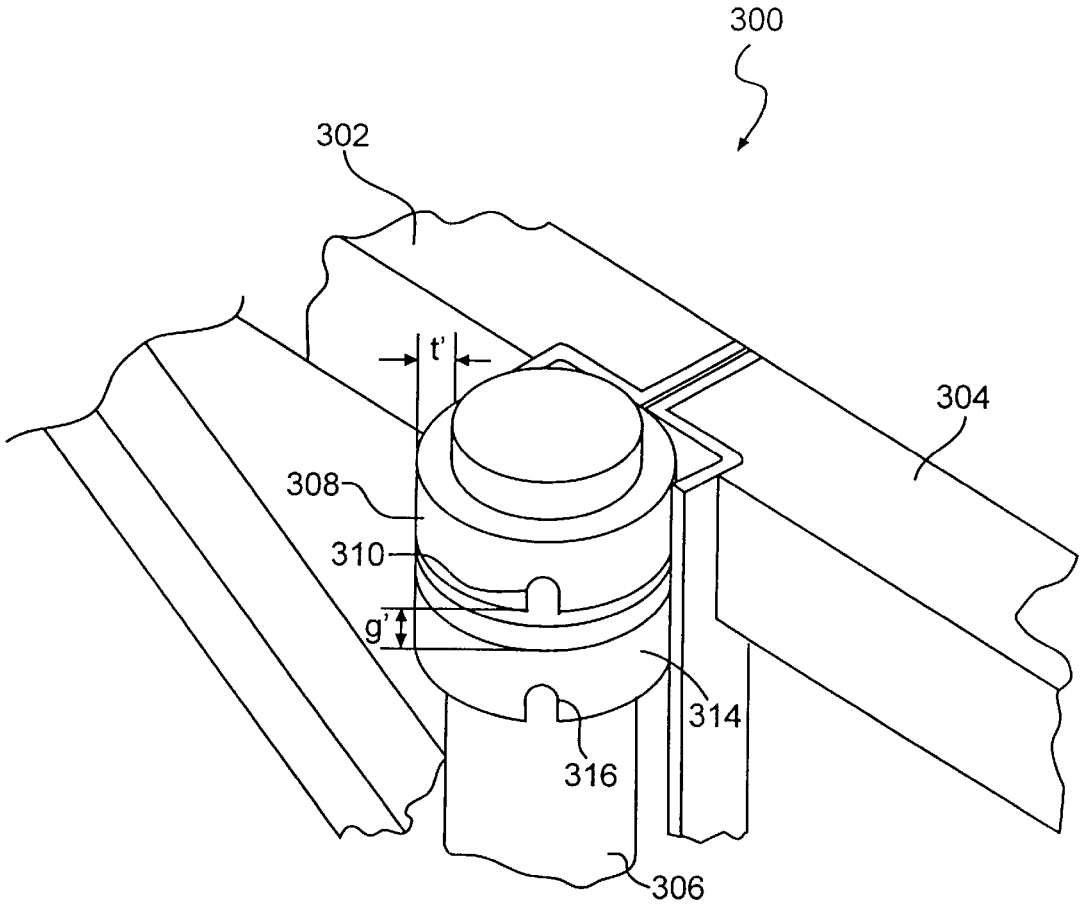
FIG. 17 is a close-up perspective view of two seat frames rotatably and slidably connected to a support pole.

When both seats of the tandem seat (300) are occupied (as shown in FIG. 16), two opposing upper index pin receiving portions (310) on the lower surface of the upper right index ring (308) engage the upper index pin (324) on the support pole (306). The lower right index ring (312), having an inside diameter slightly smaller than the outside diameter of the spacer ring (320), rests on the top surface of the spacer ring (320). Likewise, the two opposing lower index pin receiving portions (316) on the lower surface of the upper left index ring (314) engage the lower index pin (326) on the support pole (306). The upper index pin (324) and the lower index pin (326) are positioned on the support pole (306) so that a gap (g') is created when the upper right index ring (308) and the upper left index ring (314) engage the upper and lower index pins (324, 326), respectively. The spacer ring (320) has a height (h) such that a gap (g") is created between the lower surface of the lower right index ring (312) and the upper surface of the lower left index ring (318).

Stowing one or both of the seats may be accomplished as follows. To stow the seat connected to the right frame (304), the right frame (304) is lifted upward, disengaging two of the opposing upper index pin receiving portions (310) from the upper index pin (324). The right frame (304) is then rotated until the two other opposing upper index pin receiving portions (310) are directly above the upper index pin (324). The right frame (304) is then guided downward so that the two other opposing upper index pin receiving portions (310) engage the upper index pin (324), locking the right frame (304) in its stowed position. Similarly, the left frame (302) is lifted upwardly, disengaging two of the opposing lower index pin receiving portions (316) from the lower index pin (326). The gaps g' and g" allow the left frame (302) to be raised upwardly without requiring the right frame (304) to be raised upwardly or rotated. The left frame (302) is then rotated until the two other opposing lower index pin receiving portions (316) are directly above the lower index pin (326). The left frame (302) is then guided downward so that the two other opposing lower index pin receiving portions (316) engage the lower index pin (326), locking the left frame (302) in its stowed position. This configuration allows the left frame (302) or the right frame (304) to be stowed or opened independently of one another.

It will be apparent to those skilled in the art that various modifications and variations can be made in the details of the present invention without departing from the spirit or scope of the invention. Thus, it is intended that the present invention cover the modifications and variations of this invention provided they come within the scope of the appended claims and their equivalents.

What is claimed is:

1. A stadium seat comprising a seat portion said seat portion being substantially parallel to the ground in a first position and configured for being substantially perpendicular to the ground in a second position;

a sliding support member; and a central pivot point, said sliding support member supporting said seat portion and slidably connected to said central pivot point allowing said seat portion to rotate about said central pivot point and to slide left and right.

2. A seating assembly comprising;

pair of seats mounted to a first post, said pair of seats rotatably connected to said first post to allow said pair of seats to fold up and rotate about said first post to establish an open area, and a single seat mounted in a first position to a second post adjacent to said pair of seats, said single seat rotatably and slidably connected to said second post to allow said single seat to slide horizontally with respect to said second post and to rotate about said second post into a second position to expand said open area to a dimension sufficient to accommodate a standard wheelchair.

3. The invention according to claim 2, wherein said single seat in said first position defines a space behind it, said single seat slidably connected to said second post in such a manner that said single seat, when in said second position avoids encroaching upon the space defined behind said single seat in the first position.

4. A method for providing wheelchair accessible seating comprising a single seat slidably and pivotally connected to a post and a pair of foldable seats pivotally connected to a central post, the method comprising the steps of:

(1) sliding said single seat to a predetermined location;

(2) folding one of said pair of seats adjacent to said predetermined location; and (3) placing a wheelchair in said predetermined location.

* * * * *

UNITED STATES PATENT AND TRADEMARK OFFICE

CERTIFICATE OF CORRECTION

PATENT NO. : 6,254,185 B1
DATED : July 3, 2001
INVENTOR(S) : Staehlin et al.

It is certified that error appears in the above-identified patent and that said Letters Patent is hereby corrected as shown below:

Title page,
Item [60], Provisional Application Data,
Line 1, "Feb. 17" should read -- Feb. 19 --.

Column 6, claim 1,
Line 58, after "a seat portion", insert a comma.

Column 7, claim 2,
Line 1, "comprising;" should read -- comprising: --
Line 2, before "pair of seats", insert -- a --.

Signed and Sealed this

Fourth Day of December, 2001

*Attest:*

Nicholas P. Godici

*Attesting Officer*

NICHOLAS P. GODICI
*Acting Director of the United States Patent and Trademark Office*